US007051642B2

(12) United States Patent
Kageyama

(10) Patent No.: US 7,051,642 B2
(45) Date of Patent: May 30, 2006

(54) LIQUID CONTAINER

(75) Inventor: Hidehei Kageyama, Kawagoe (JP)

(73) Assignee: Kotobuki Printing Co., Ltd., Kyoto (JP)

( * ) Notice: Subject to any disclaimer, the term of this patent is extended or adjusted under 35 U.S.C. 154(b) by 0 days.

(21) Appl. No.: 10/896,017

(22) Filed: Jul. 22, 2004

(65) Prior Publication Data

US 2006/0000350 A1 Jan. 5, 2006

(30) Foreign Application Priority Data

Jan. 7, 2004 (JP) ..... 2004-001880

(51) Int. Cl.
*A45D 34/04* (2006.01)
*B65D 83/00* (2006.01)

(52) U.S. Cl. ..... 92/136; 401/172; 401/174

(58) Field of Classification Search ..... 92/136; 401/172, 173, 174
See application file for complete search history.

(56) References Cited

U.S. PATENT DOCUMENTS 5,827,002 A * 10/1998 Nakajima ..... 401/174
5,851,079 A * 12/1998 Horstman et al. ..... 401/174
6,155,735 A * 12/2000 Nakajima ..... 401/172
6,227,739 B1 * 5/2001 Kageyama ..... 401/172
6,474,891 B1 * 11/2002 Liu ..... 401/174
6,688,796 B1 * 2/2004 Liu ..... 401/172
6,752,558 B1 * 6/2004 Hsu ..... 401/172
6,793,431 B1 * 9/2004 Tsai ..... 401/172
6,918,515 B1 * 7/2005 Noguchi ..... 401/172

FOREIGN PATENT DOCUMENTS

JP 6-14844 4/1994
JP 2001-299442 10/2001

* cited by examiner

*Primary Examiner*—Thomas E. Lazo
(74) *Attorney, Agent, or Firm*—McGinn IP Law Group, PLLC

(57) ABSTRACT

The liquid container includes a body for having a tank portion housing a liquid, and having a supply port on a tip end side, a piston for moving forward inside the tank portion, a piston rod connected with the piston and extending rearward, a manipulating cylinder rotatably mounted to a rear portion of the body, and a rotation stopping cylinder unrotatably disposed in a rear inner portion of the body. A conversion mechanism for converting relative rotation between the manipulating cylinder and the body into movement of the piston rod in an axial direction with respect to the body is provided between the manipulating cylinder and the rotation stopping cylinder, and a rotating direction restricting mechanism for restricting the rotating direction of the manipulating cylinder and the body to one direction is provided. The manipulating cylinder and the rotation stopping cylinder are integrally connected by fitting the annular raised portion formed on the rotation stopping cylinder into the annular recessed portion formed on the manipulating cylinder.

7 Claims, 5 Drawing Sheets

LIQUID CONTAINER

BACKGROUND OF THE INVENTION

1. Field of the Invention

The present invention relates to a liquid container for housing a liquid such as cosmetic ink, writing ink and a correction liquid, etc, and supplying the liquid from a tip end side.

2. Description of the Related Art

Conventionally, as a container for housing a liquid of this kind, there is the one described in, for example, Japanese Utility Model Publication No. 6-14844. The liquid container described in this Official Gazette is comprised of a barrel body in which a coating liquid storing portion is formed, a threaded bar projectingly provided at a piston slidably fitted in the storing portion, and a rotary cylinder integrally connecting an inner cylinder member and an outer cylinder member. The outer cylinder member has a ring protruded rib and an engaging claw, which is capable of being resilient in a tip end portion of the outer cylinder member in an axial direction, so that the ring protruded rib is press-fitted into a ring groove at the rear end of the barrel body to rotatably connect the rotary cylinder to the barrel body, and the engaging claw of the outer cylinder member is elastically meshed with a ratchet tooth integrally formed in a circumferential direction in the barrel body to construct a ratchet mechanism. A threaded hole is provided in the inner cylinder member of the rotary cylinder to be screwed onto the threaded bar, two plane portions formed on both sides over the entire length of the threaded bar are slidably fitted in a slide hole formed in a partition wall of the rear end of the storing portion of the barrel body, and the threaded bar is moved forward without being rotated by the rotation of the rotary cylinder to press the piston in the axial direction to supply a coating liquid.

When the rotary cylinder is rotated with respect to the barrel body, relative rotation occurs between the inner cylinder member of the rotary cylinder and the threaded bar because the threaded bar is slidably fitted in the slide hole formed in the partition wall of the rear end portion of the storing portion of the barrel body, and the threaded bar advances by thread engagement between the threaded bar and the threaded hole of the rotary cylinder to press the piston in the axial direction to make it possible to supply a coating liquid to a tip end of the barrel body.

However, with the liquid container described in this Official Gazette, the partition wall is formed at the rear end of the storing portion of the barrel body, and the slide hole fitted on the two plane portions of the threaded bar has to be formed on the partition wall, and further, the ratchet teeth have to be integrally formed in the inner circumferential direction of the barrel body, thus causing the problem that production of the barrel body is difficult in molding. Upon assembly, the piston and the threaded bar are inserted from a front of the barrel body, the threaded bar is passed through the slide hole of the partition wall, and thereafter the rotary cylinder is inserted from a rear of the barrel body and the inner cylinder member of the rotary cylinder has to be screwed on the threaded bar, thus causing the problem that the assembly is difficult. Therefore, it is difficult to produce commercially practical mass production products with the construction of the liquid container of the above-described Official Gazette.

On the other hand, Japanese Patent Laid-Open No. 2001-299442 has its object to provide a liquid container which is excellent in moldability and easiness of assembly, suitable for mass production and capable of being commercialized, in order to solve the above problems. The liquid container comprises a body having a tank portion for housing a liquid and having a supply port on a tip end side, a piston for moving forward inside the tank portion, a piston rod integrally connected to the piston to extend rearward, and having a male thread formed on a peripheral surface, a manipulating cylinder rotatably mounted to a rear portion of the body, a piston rod guide in which a female threaded hole screwed onto the male thread of the piston rod and which rotates integrally with the manipulating cylinder, and a ratchet cylinder which is fixed to a rear inner portion of the body and in which an insertion hole through which the piston rod is unrotatably inserted, and sawteeth are formed at a front end of the manipulating cylinder, and ratchet teeth which are meshed with the saw teeth and are capable of projecting and retracting in the axial direction are formed at a rear end of the ratchet cylinder.

According to this construction, the ratchet teeth and the insertion hole are formed on the ratchet cylinder, and its production is simplified to make its commercialization possible.

SUMMARY OF THE INVENTION

The present invention has its object to further improve the construction described in Japanese Patent Laid-Open No. 2001-299442 and provide a liquid container more excellent in assembling easiness.

In order to achieve the above-described object, a liquid container according to the present invention comprises a body for having a tank portion housing a liquid, and having a supply port on a tip end side thereof, a piston for moving forward inside the tank portion, a piston rod connected with the piston and extending rearward from the piston, a manipulating cylinder rotatably mounted to a rear portion of the body, and a rotation stopping cylinder unrotatably fixed to a rear inner portion of the body. A conversion mechanism for converting relative rotation between the manipulating cylinder and the body into movement of the piston rod in an axial direction with respect to the body is provided between the manipulating cylinder and the rotation stopping cylinder, and a rotating direction restricting mechanism is provided for restricting the rotating direction of rotation between the manipulating cylinder and the body to one direction. The manipulating cylinder and the rotation stopping cylinder are integrally connected.

The conversion mechanism can be constructed by an insertion hole, which is formed in the manipulating cylinder and through which the piston rod unrotatably is inserted, and a female threaded hole which is formed in the rotation stopping cylinder and screwed onto the piston rod.

The rotating direction restricting mechanism can be a ratchet mechanism formed between the manipulating cylinder and the rotation stopping cylinder.

The ratchet mechanism can be constructed by a number of ratchet teeth formed along a circumferential direction on one of the manipulating cylinder and the rotation stopping cylinder, and sawteeth formed at tip ends of elastic pieces which are formed on the other of the manipulating cylinder and the rotation stopping cylinder to extend in a circumferential direction.

Preferably, an annular raised portion formed on one of the manipulating cylinder and the rotation stopping cylinder is fitted in an annular recessed portion formed on the other of the manipulating cylinder and the rotation stopping cylinder, and thereby the manipulating cylinder and the rotation stopping cylinder are integrally connected.

According to the present invention, as a result that the manipulating cylinder and the rotation stopping cylinder are integrally connected, they are unitized and can be easily handled at the time of assembly, and this unit is mounted to the body, whereby assembly can be easily performed.

The present disclosure relates to subject manner contained in Japanese Patent Application No. 2004-1880, filed on Jan. 7, 2004, which is expressly incorporated herein by reference in its entirety.

DETAILED DESCRIPTION OF THE PREFERRED EMBODIMENTS

Figure 1:
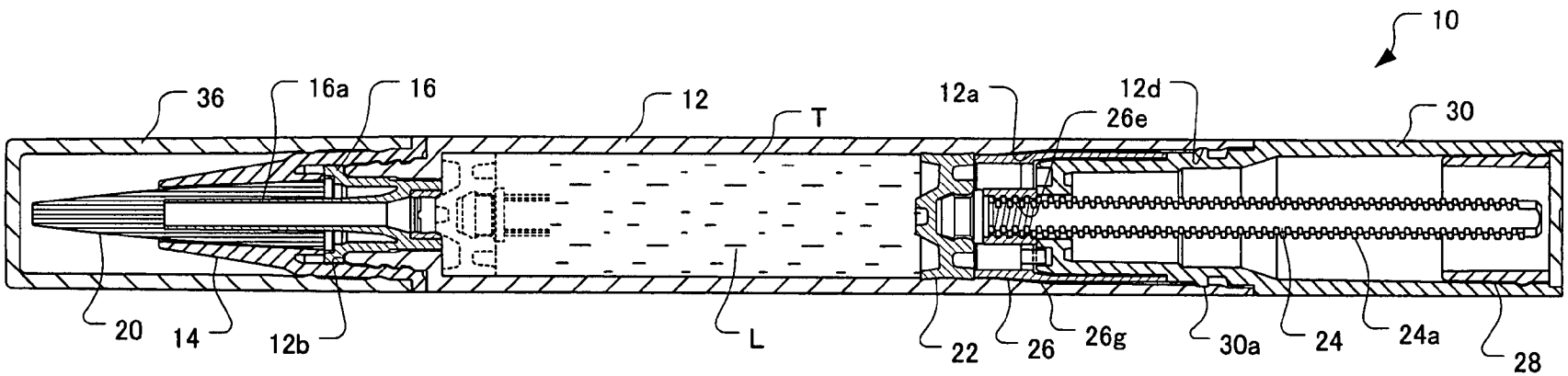
FIG. 1 is an overall longitudinal sectional view showing an embodiment of a liquid container of the present invention.
Figure 2:
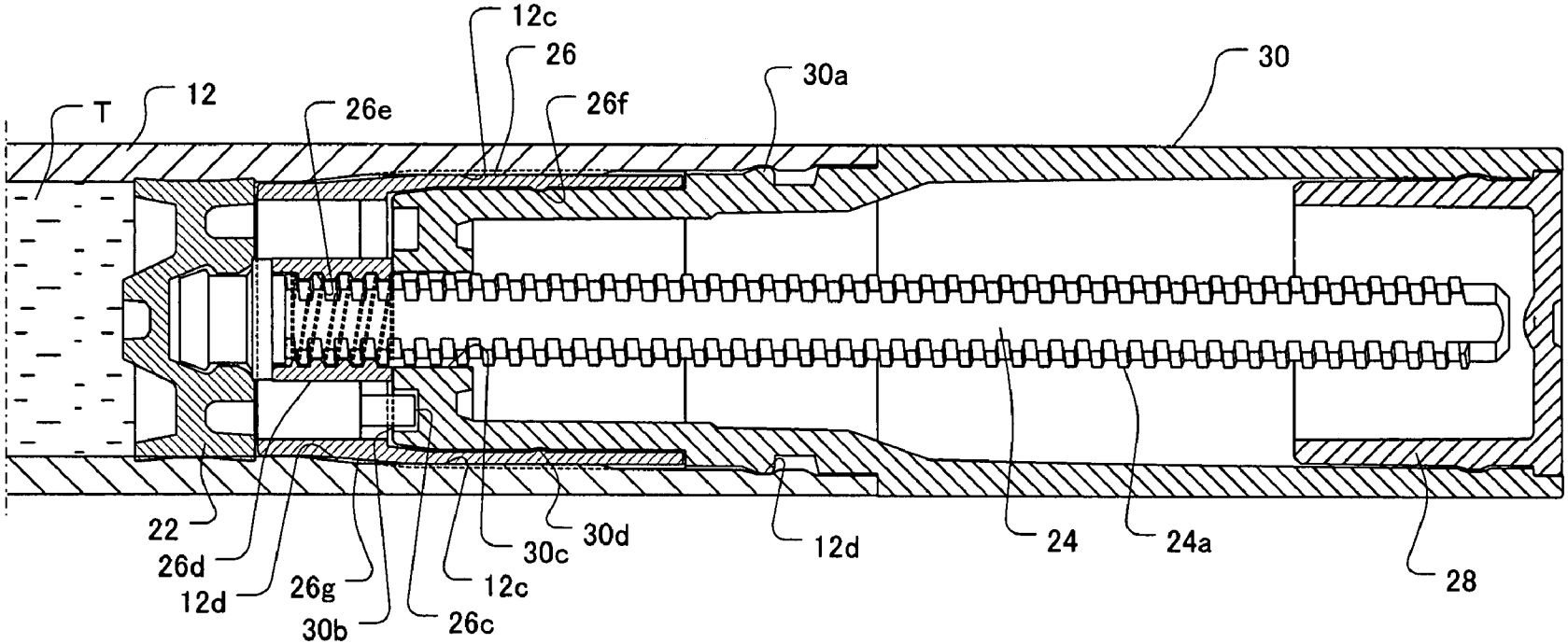
FIG. 2 is a longitudinal sectional view showing a main part in FIG. 1.

Hereinafter, an embodiment of the present invention will be explained referring to the drawings. FIG. 1 is an overall longitudinal cross-sectional view showing an embodiment of a liquid container of the present invention, and FIG. 2 is a main cross-sectional view of the liquid container.

In the drawings, a liquid container 10 includes a body 12 having a tank portion T housing a liquid L such as a correction liquid, writing ink and a cosmetic ink, etc, and having a liquid supply port 12*b* at a tip end, a leading tool 14 threadably mounted to a tip end of the body 12, a holder 16 which is fixed to the leading tool 14 and has a pipe portion 16*a*, a brush (tip end coating body) 20, a base portion of which a tip end of a pipe portion 16*a* is inserted in and is fixed inside the leading tool 14, a piston 22, which is slidable inside the tank portion T, a piston rod 24 which is connected with the piston 22, and extends rearward from the piston, with a male thread 24*a* being formed on a peripheral surface, a manipulating cylinder 30 relatively rotatably mounted to a rear portion of the body 12, a rotation stopping cylinder 26 which is unrotatably fixed within a rear inner portion of the body 12, and a tail plug 28 for sealing a rear end of the manipulating cylinder 30. A cap 36 for protecting the brush 20 when the liquid container is not used is detachably attached to the leading tool 14.

Figure 3:
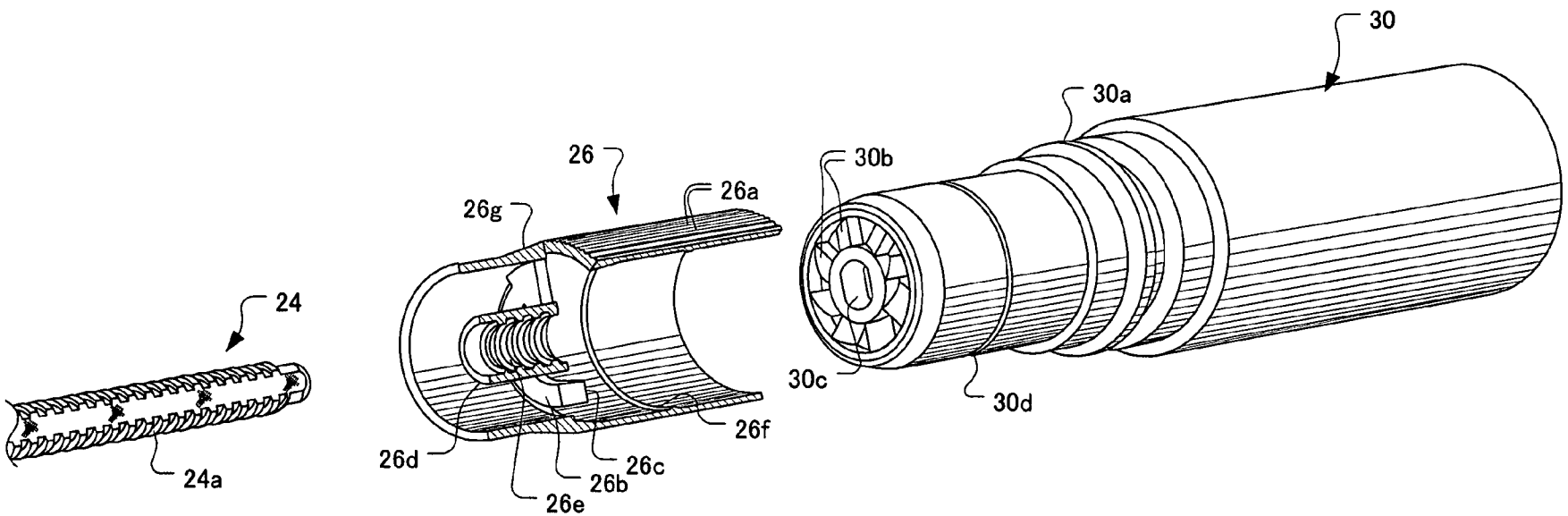
FIG. 3 is an exploded perspective view of a manipulating cylinder, a rotation stopping cylinder and a part of a piston rod.
Figure 5:
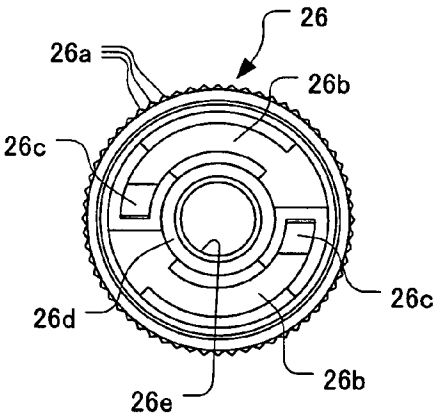
FIG. 5 is a view of a rotation stopping cylinder seen from a rear.
Figure 4:
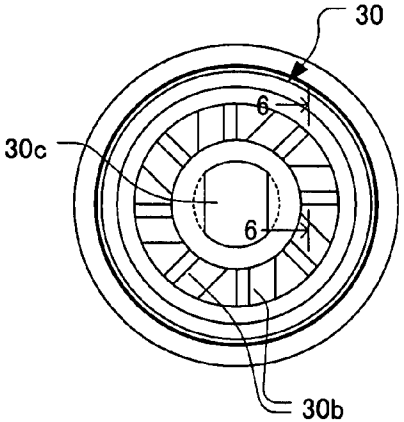
FIG. 4 is a view of the manipulating cylinder seen from a front.

An annular protrusion 30*a* is formed on an outer peripheral surface of a front portion of the manipulating cylinder 30, and the annular protrusion 30*a* is fitted into an annular recessed portion 12*d* formed on an inner peripheral surface of a rear portion of the body 12, whereby the manipulating cylinder 30 is mounted to the body 12 so as to be rotatable relative to the body 12. A plurality of ratchet teeth 30*b* are formed along a circumferential direction on an end surface of a tip end of the manipulating cylinder 30, and an insertion hole 30*c* is formed on an inner diameter side of the manipulating cylinder 30 (see FIG. 3 and FIG. 4).

The ratchet teeth 30*b* of the manipulating cylinder 30 are ones of which projected height in its axial direction gradually changes so that their section seen along the circumferential direction forms a shape of sawteeth.

A shape of the insertion hole 30*c* of the manipulating cylinder 30 is not circular, but a non-circular shape formed by notching a part(s) from the circular shape or an oval shape in this embodiment, and corresponds to the sectional shape of the piston rod 24. This piston rod 24 penetrates through this insertion hole 30*c*, and thereby the piston rod 24 is unrotatable with respect to the manipulating cylinder 30.

In addition, an annular recessed portion 30*d* is formed in a front portion a head of the annular protrusion 30*a*, on an outer peripheral surface of the front portion of the manipulating cylinder 30.

A number of ribs 26*a* extending in the axial direction are formed on an outer peripheral surface of a rear portion of the rotation stopping cylinder 26. Some of a number of ribs 26*a* are fitted in a plurality of ribs 12*c* formed on the inner peripheral surface of the body 12, so that the rotation stopping cylinder 26 is unrotatable with respect to the body 12.

A pair of elastic pieces 26*b* and 26*b* are formed on an inner side of a front portion of the rotation stopping cylinder 26. A pair of elastic pieces 26*b* and 26*b* extend in the circumferential direction respectively, and their tip ends become sawteeth 26*c* formed in a sawteeth shape in section so as to be meshed with the ratchet teeth 30*b* (see FIGS. 6A and 6B).

An inner cylinder portion 26*d* is formed on a further inner side of the rotation stopping cylinder 26, and an inner peripheral surface of the inner cylinder portion 26*d* becomes a female threaded hole 26*e* which is screwed onto the male thread 24*a* of the piston rod 24.

An annular raised portion 26*f* is formed on an inner peripheral surface of a rear portion of the rotation stopping cylinder 26, and the annular raised portion 26*f* is fitted into the annular recessed portion 30*d* formed on the outer peripheral surface of the front portion of the manipulating cylinder 30, whereby the rotation stopping cylinder 26 and the manipulating cylinder 30 are integrally connected with each other but they are rotatable with respect to each other in the state in which its rotating direction is restricted by ratchet teeth 30*b* and the sawteeth 26*c*. In this example, the tip end portion of the manipulating cylinder 30 is inserted into the rear end portion of the rotation stopping cylinder 26, but the present invention is not limited to this, and the rear end portion of the rotation stopping cylinder 26 may be inserted into the tip end portion of the manipulating cylinder 30. In this case, an annular recessed portion is formed on the rotation stopping cylinder 26, and an annular raised portion which is fitted into the annular recessed portion is formed on the manipulating cylinder 30.

The insertion hole 30*c* formed in the manipulating cylinder 30, through which the piston rod 24 is unrotatably inserted, and a female threaded hole 26*e*, which is formed in the rotation stopping cylinder 26 and is screwed onto the piston rod 24, construct a conversion mechanism which converts relative rotation between the manipulating cylinder 30 and the body 12 into the movement in the axial direction of the piston rod 24 with respect to the body 12. However, this conversion mechanism can be constructed optionally, and for example, it is possible to form the insertion hole, through which the piston rod 24 is unrotatably inserted, in the rotation stopping cylinder 26, and to form the female threaded hole, which is screwed onto the piston rod 24, in the manipulating cylinder or another component unrotatable relative to the manipulating cylinder.

A rotating direction restricting mechanism is constructed by a ratchet mechanism constructed by a number of ratchet teeth 30*b* which are formed along the circumferential direction of the manipulating cylinder 30, sawteeth 26*c* which are formed at the tip end of the elastic pieces 26*b* which are formed in the rotation stopping cylinder 26 and extend in the circumferential direction. The relationship of the ratchet teeth and the sawteeth may be reversed, namely, the sawteeth may be formed on the manipulating cylinder 30 and the ratchet teeth may be formed on the rotation stopping cylinder 26.

Upon assembly of the liquid container 10, the other components except the body 12 are unitized, and assembled to the body 12.

Figure 7:
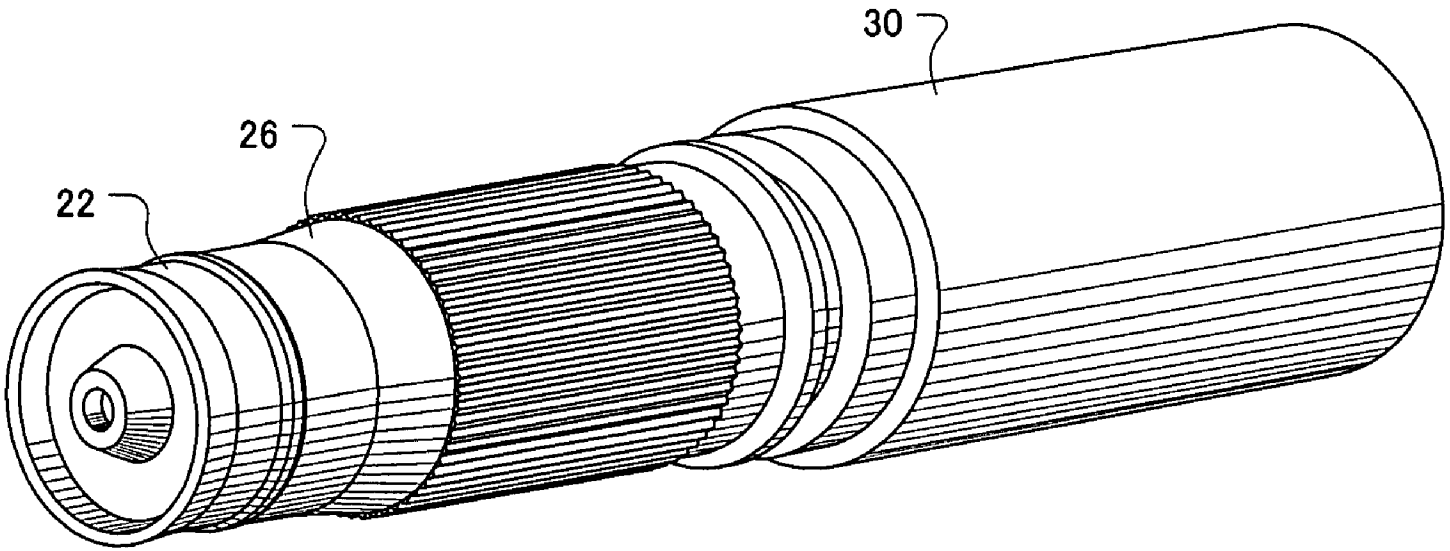
FIG. 7 is a perspective view showing a rear end unit.

Namely, the tip end of the piston rod 24 is connected to the piston 22 by press-fitting first, the male thread 24*a* of the piston rod 24 is inserted and screwed into the female threaded hole 26*e* of the inner cylinder portion 26*d* of the rotation stopping cylinder 26 from the tip end side of the female threaded hole 26*e*. Then, the male thread 24*a* of the piston rod 24 is passed through the rotation stopping cylinder 26 until the rear end surface of the piston 22 approximately contacts the tip end surface of the rotation stopping cylinder 26. Next, the male thread 24*a* of the piston rod 24 is inserted through the insertion hole 30*c* of the manipulating cylinder 30 to which the tail plug 28 is mounted, and the annular raised portion 26*f* of the rotation stopping cylinder 26 is fitted in the annular recessed portion 30*d* at the tip end of the manipulating cylinder 30. Simultaneously, the sawteeth 26*c* of the elastic pieces 26*b* and 26*b* elastically contact the ratchet teeth 30*b* of the manipulating cylinder 30. In this manner, the manipulating cylinder 30 and the rotation stopping cylinder 26 are connected as a rear end unit relatively rotatable only in one direction (see FIG. 7). The piston 22 is in the closest vicinity to the rotation stopping cylinder 26. The manipulating cylinder 30 and the rotation stopping cylinder 26 do not always need to be firmly connected, and it is sufficient if only they are connected to an extent necessary to maintain the rear end unit at the time of assembly.

This rear end unit is inserted from the rear end of the body 12, and the annular protrusion 30*a* of the manipulating cylinder 30 is fitted in the annular recessed portion 12*d* of the body 12. At the same time, the ribs 26*a* of the rotation stopping cylinder 26 are fitted in the ribs 12*c* of the body 12, and a taper portion 26*g* formed on the outer peripheral surface of the rotation stopping cylinder 26 is fitted to a taper portion 12*a* formed on the inner peripheral surface of the body 12.

A tip end unit is formed by assembling the leading tool 14, the holder 16 and the brush 20, the liquid is charged into the tank portion T of the body 12, the tip end unit is inserted from the tip end of the body 12, the tip tool 14 is screwed onto the body 12, and thereby the assembly is finished.

When the liquid container 10 constructed as above is used, the cap 36 is removed, and coating is performed by using the brush 20. When the liquid is desired to be further supplied from the brush 20, the manipulating cylinder 30 is rotated with respect to the body 12.

When the manipulating cylinder 30 is rotated with respect to the body 12, the piston rod 24 is rotated together with the manipulating cylinder 30. Since the rotation stopping cylinder 26 of which rotation is fixed to the body 12 does not rotate on the other hand, relative rotation occurs between the rotation stopping cylinder 26 and the piston rod 24, the piston rod 24 moves forward by the screwing between the female threaded hole 26*e* of the rotation stopping cylinder 26 and the male thread 24*a* of the piston rod 24. Since the piston 22 moves forward in the tank portion T, the liquid L inside the tank portion T is pressed to the supply port 12*b* provided on the tip end side of the body 12, passes inside the pipe portion 16*a*, is supplied from the tip end of the brush 20 and is able to be used.

Figure 6B:
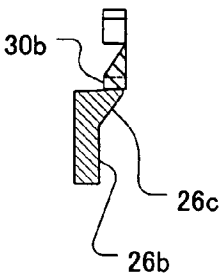
FIGS. 6A and 6B are partial cross-sectional views seen along the line 6—6 in FIG. 4, showing engagement of a ratchet tooth and a sawtooth.
Figure 6A:
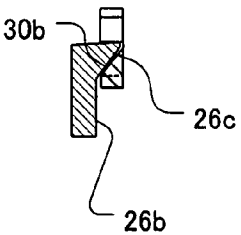

As shown in FIGS. 6A and 6B, at the time of rotation of this manipulating cylinder 30, the ratchet teeth 30*b* of the manipulating cylinder 30 rotates with the elastic pieces 26*b* projected and retracted in the axial direction while sliding on the inclined surfaces of the sawteeth 26*c* of the elastic pieces 26*b* of the rotation stopping cylinder 26. As a result that the elastic pieces 26*b* project and retract, ticking sound occurs, and a user can obtain feeling of click. When the user tries to rotate the manipulating cylinder 30 in the reverse direction by mistake, the ratchet teeth 30*b* of the manipulating cylinder 30 and the sawteeth 26*c* of the rotation stopping cylinder 26 are meshed with each other and inhibit the relative movement, and therefore the manipulating cylinder 30 cannot be rotated. Accordingly, the manipulating cylinder 30 is always rotated only in the direction in which the piston 22 moves forward inside the tank portion T. The state shown by the phantom line in FIG. 1 shows the state in which the liquid L is exhausted, and the piston 22 moves forward.

As described above, in this embodiment, the manipulating cylinder 30 including the piston rod 24 and the rotation stopping cylinder 26 are unitized at the time of assembly, and the rear end unit is only inserted into the body 12, thus extremely simplifying the assembly. On unitizing this, the manipulating cylinder 30 and the rotation stopping cylinder 26 are integrally connected, and therefore handling is enhanced.

In the above embodiments, it is appropriately possible to construct the component expressed by the single component by a plurality of components, or to construct the component expressed by a plurality of components by a single component.

While the principles of the invention have been described above in connection with specific embodiments, and particular modifications thereof, it is to be clearly understood that this description is made only by way of example and not as a limitation on the scope of invention.

What is claimed is:

1. A liquid container, comprising:

a body having a tank portion for housing a liquid, and having a supply port at a tip end side thereof;

a piston for moving forwardly inside the tank portion;

a piston rod connected with the piston and extending rearwardly from the piston;

a manipulating cylinder rotatably mounted to a rear portion of the body; and a rotation stopping cylinder unrotatably disposed in a rear inner portion of the body, wherein a conversion mechanism for converting relative rotation between the manipulating cylinder and the body into movement of the piston rod in an axial direction with respect to the body is provided between the manipulating cylinder and the rotation stopping cylinder, and a rotating direction restricting mechanism for restricting the rotating direction of rotation between the manipulating cylinder and the body to one direction is provided, and the manipulating cylinder and the rotation stopping cylinder are integrally connected, wherein said conversion mechanism is constructed by an insertion hole, which is formed in the manipulating cylinder and through which the piston rod is unrotatably inserted, and a female threaded hole which is formed in the rotation stopping cylinder and screwed onto the piston rod.

2. The liquid container according to claim 1, wherein said rotating direction restricting mechanism comprises a ratchet mechanism formed between the manipulating cylinder and the rotation stopping cylinder.

3. The liquid container according to claim 2, wherein said ratchet mechanism is constructed by a number of ratchet teeth formed along a circumferential direction on one of the manipulating cylinder and the rotation stopping cylinder, and sawteeth formed at tip ends of elastic pieces formed on the other of the manipulating cylinder and the rotation stopping cylinder to extend in a circumferential direction.

4. The liquid container according to claim 3, wherein an annular raised portion formed on one of the manipulating cylinder and the rotation stopping cylinder is fitted in an annular recessed portion formed on the other of the manipulating cylinder and the rotation stopping cylinder, and thereby the manipulating cylinder and the rotation stopping cylinder are integrally connected.

5. The liquid container according to claim 2, wherein an annular raised portion formed on one of the manipulating cylinder and the rotation stopping cylinder is fitted in an annular recessed portion formed on the other of the manipulating cylinder and the rotation stopping cylinder, and thereby the manipulating cylinder and the rotation stopping cylinder are integrally connected.

6. The liquid container according to claim 1, wherein an annular raised portion formed on one of the manipulating cylinder and the rotation stopping cylinder is fitted in an annular recessed portion formed on the other of the manipulating cylinder and the rotation stopping cylinder, and thereby the manipulating cylinder and the rotation stopping cylinder are integrally connected.

7. The liquid container, comprising:

a body having a tank portion for housing a liquid, and having a supply port at a tip end side thereof;

a piston for moving forwardly inside the tank portion;

a piston rod connected with the piston and extending rearwardly from the piston;

a manipulating cylinder rotatably mounted to a rear portion of the body; and a rotation stopping cylinder unrotatably disposed in a rear inner portion of the body, wherein a conversion mechanism for converting relative rotation between the manipulating cylinder and the body into movement of the piston rod in an axial direction with respect to the body is provided between the manipulating cylinder and the rotation stopping cylinder, and a rotating direction restricting mechanism for restricting the rotating direction of rotation between the manipulating cylinder and the body to one direction is provided, and the manipulating cylinder and the rotation stopping cylinder are integrally connected.

* * * * *